US009346584B1

(12) United States Patent
Kokojan

(10) Patent No.: US 9,346,584 B1
(45) Date of Patent: May 24, 2016

(54) TANK BATTERY PEDESTAL SYSTEM

(71) Applicant: Murray Services Inc., Hinton, OK (US)

(72) Inventor: Joe Anthony Kokojan, Hinton, OK (US)

(73) Assignee: Murray Services Inc., Hinton, OK (US)

( * ) Notice: Subject to any disclaimer, the term of this patent is extended or adjusted under 35 U.S.C. 154(b) by 0 days.

(21) Appl. No.: 14/735,910

(22) Filed: Jun. 10, 2015

Related U.S. Application Data

(60) Provisional application No. 62/012,583, filed on Jun. 16, 2014.

(51) Int. Cl.
*B65D 19/00* (2006.01)
*B65D 19/18* (2006.01)

(52) U.S. Cl.
CPC ..... *B65D 19/18* (2013.01); *B65D 2519/008* (2013.01); *B65D 2519/00278* (2013.01); *B65D 2519/00567* (2013.01); *B65D 2519/00791* (2013.01); *B65D 2519/00796* (2013.01); *B65D 2519/00865* (2013.01)

(58) Field of Classification Search
CPC .. B65D 19/18; B65D 19/002; B65D 19/0022; B65D 19/0053; B65D 19/0055; B65D 19/0067; B65D 19/0069; B65D 19/0089; B65D 19/0091
USPC ..... 108/56.1
See application file for complete search history.

(56) References Cited

U.S. PATENT DOCUMENTS

| | | | | | |
|---|---|---|---|---|---|
| 4,287,836 | A * | 9/1981 | Aoki | B65D 19/0069 | 108/57.1 |
| 4,625,869 | A * | 12/1986 | Kuipers | B65D 19/0095 | 108/56.1 |
| 5,105,746 | A * | 4/1992 | Reynolds | B65D 19/0012 | 108/54.1 |
| 5,178,075 | A * | 1/1993 | Kanazawa | B65D 19/0069 | 108/56.1 |
| 5,582,113 | A * | 12/1996 | Langenbeck | B65D 19/0069 | 108/56.1 |
| 8,176,857 | B2 * | 5/2012 | Ochs | A47B 87/002 | 108/23 |
| 8,814,110 | B2 * | 8/2014 | Crager | B65D 19/0002 | 108/57.26 |
| 2010/0096075 | A1 | 4/2010 | Perkins et al. | | |

* cited by examiner

*Primary Examiner* — Daniel Rohrhoff
(74) *Attorney, Agent, or Firm* — Martin G. Ozinga; Phillips Murrah PC

(57) ABSTRACT

The present invention comprises a series of interconnectable polyethylene plastic members, which can be interlocked together to form a tank base system sized to provide a load-bearing support for an aboveground storage tank and configured to reduce rusting and corrosion of the tank from ground moisture, chemicals, and so forth wherein the interconnectable polyethylene plastic members are generally pie piece shaped and modular such that when assembled a generally circular base is formed of light weight and sturdy support members that are generally non-corrosive, chemical resistant, tolerant to temperature variations, and non-absorbing.

9 Claims, 7 Drawing Sheets

TANK BATTERY PEDESTAL SYSTEM

CROSS-REFERENCE TO RELATED APPLICATIONS

Priority is claimed from provisional patent application U.S. Ser. No. 62/012,583 filed on Jun. 16, 2014 and incorporated by reference herein.

BACKGROUND OF THE INVENTION

1. Field of the Invention

In general, the present invention relates to an apparatus, system and method of providing a tank base and or pedestal for oil and gas operations. More particularly, the present invention provides a polyethylene plastic tank base system sized to provide a load-bearing support for an aboveground storage tank and is generally non-corrosive, chemical resistant, tolerant to temperature variations and non-absorbing.

2. Description of the Prior Art

Tanks and tank batteries are essential elements in oil and gas production. In the oil and gas industry, the term "battery" generally refers to a group of containers called "tanks" that are a grouping of interconnected metal storage tanks situated to receive the output of one or more wells for crude oil production and or a producing lease. A tank battery is also called a battery. Typically, in the tank battery, the oil volume is measured and tested before pumping the oil into the pipeline system and the group of tanks at a well site is used to store oil prior to sale to a pipeline company. A typical tank battery contains one or more tanks and usually has a capacity equal to four days production.

It is desirable to raise a tank and or tank battery off the ground. Due to the nature of the use of these tanks, it is not unusual for the bottom of the tank to be situated where water, chemicals, corrosive elements, and liquids in general are present and can accumulate at the base of the tank. Because these tanks are made from metal and exposed to highly corrosive elements, these tanks are prone to rusting and deteriorating, which is obviously undesirable and potentially a safety risk as well as an environmental risk.

Tanks are typically raised to minimize contact with fluids thus reducing and or preventing corrosion as well as allowing for proper hook up of pipes and fittings. Furthermore, a majority of tanks have a manhole at the bottom of the tank that is bolted on. This hole will need to be accessed at various points throughout the tanks life for cleaning, plumbing and repair work. If that manhole is at ground level it cannot easily be removed.

The prior art for providing a base is generally one of two methods. The first is generally providing a metal ring with a larger diameter than the tank and filling it with pea gravel before setting the tank in place on top of the pea gravel and the second is generally providing a dense foam ring with a larger diameter than the tank and placing the tank on the foam base.

The metal ring construction typically utilizes a grade band metal bolted together to form a base greater than the diameter of the containment tank it supports. The diameter of the support structure may be a base of poured pea gravel to form a 3" to 8" base inside the ring. This allows the tank to be at a level greater than the ground level and aids in the slow deterioration of the tank due to any standing fluid within the secondary tank area, whether the fluid is natural such as rainwater or accidental spills or leaks. The pea gravel currently used is naturally porous and allows for the absorption for any number of contaminants such as oil, salts, acids, and so forth that come into contact with the gravel, causing permanent contamination, which still tends to spill out of the gravel upon oversaturation. Attempts to treat or wash out the contaminants are costly, difficult, and to-date, ineffective.

The process of constructing the traditional metal tank rings takes numerous steps, time and money. First the galvanized strips of metal are bolted together on the location by dozens of small nuts and bolts forming a circle. The ring is then set in the approximate position and the first bucket of chat or pea gravel is placed into the center of the ring, once the gravel is spread towards the edges of the ring a tape measure is used to check the diameter and ensure it is perfect. The ring is repeatedly measured and then adjusted by kicking or slamming into the metal edge in order to achieve the perfect circle. Once set, more buckets of pea gravel are added by the tractor and a leveling screed is used to smooth the top of the pea gravel forming a flat surface that the tank can set on.

There are many negatives associated with these prior art devices such as, this process can take a five man crew approximately 30 minutes per ring in labor cost and requires a tractor. Furthermore, once set, it is difficult to adjust and impossible to move without starting over. Also, the pea gravel must be hauled by a heavy hauler to the location causing extra expense and environmental impact. Still further, pea gravel and chat are also highly corrosive to the bottom of a steel tank. Another negative to a galvanized tank ring is that once the pea gravel enters a containment that is lined with a plastic liner, the pea gravel can cause damage to the liner by being pushed or rubbed through. Still further, water is held or trapped by the pea gravel or chat and this mixture is also corrosive to the bottom of the tank. Many in the industry have banned pea gravel inside the containment for the above reasons.

The other generally known prior art method is utilization of a dense foam pedestal that is cut into circular patterns to fit the bottom of a tank. The foam is then coated with poly-urea and ultimately the tank is placed on top. There are also known negative features of this method such as the generally delicate and easily punctured nature of the material. Once punctured, the foam can take on liquid, loose density and fail. Furthermore, these foam pedestals are hard to haul and transport because of their size and generally being a one-piece construction. The one-piece construction also makes them prone to be blown around and damaged by strong winds during the installation process. It is also common for these types of devices to be torn during transportation in general as well as moved off the desired location with relatively small winds.

It is obviously desirable to provide a base and or pedestal in oil and gas operations in general and more specifically tank battery operations. The balance of cost, time, and operational efficiency has created a need for a new and improved tank base and or pedestal system and method. Thus, there is a need for an apparatus, method and system that provides a support structure and reduces liquid accumulation around a tank and or tank battery. The current invention provides an inexpensive, time saving, more reliable apparatus, system and method where the prior art fails.

SUMMARY OF THE INVENTION

In view of the foregoing disadvantages inherent in the known types of tank pedestals and tank protection in general now present in the prior art, the present invention provides a new and improved apparatus, system and method of use, which may be quickly installed and provides structural support as well as a riser beneath tank. As such, the general purpose of the present invention, which will be described subsequently in greater detail, is to provide a new and improved tank pedestal system, which has all the advantages of the prior art devices and none of the disadvantages.

To attain this, the present invention essentially comprises a series of interconnectable polyethylene plastic members, which can be interlocked together to form a tank base system sized to provide a load-bearing support for an aboveground storage tank and configured to reduce rusting and corrosion of the tank from ground moisture, chemicals, and so forth. The interconnectable polyethylene plastic members are generally pie piece shaped and modular such that when assembled a generally circular base is formed of light weight and sturdy support members that are generally non-corrosive, chemical resistant, tolerant to temperature variations, and non-absorbing. The current invention may be utilized in well operations, well production in general, drilling operations, tank batteries and so forth.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved tank pedestal apparatus, system and method of using the same that provides a polyethylene plastic platform that fits flush under the tank and is non-corrosive, chemical resistant, tolerant to temperature variations and non-absorbing.

Still another object of the present invention is to provide a new and improved tank pedestal apparatus, system and method of using the same, which may be easily and efficiently transported to the desired site, deployed and removed as desired.

It is a further object of the present invention to provide a new and improved tank pedestal apparatus, system and method of using the same, which is of a durable and reliable construction and may be utilized with multiple applications.

An even further object of the present invention is to provide a new and improved tank pedestal apparatus, system and method of using the same, which is susceptible to a low cost of manufacture with regard to both materials and labor, and which accordingly is then susceptible to low prices of sale to the consuming industry, thereby making such economically available to those in the field.

Still another object of the present invention is to provide a new and improved tank pedestal apparatus, system and method of using the same, which provides all of the advantages of the prior art, while simultaneously overcoming some of the disadvantages normally associated therewith.

Another object of the present invention is to provide a new and improved tank pedestal apparatus, system and method of using the same that is environmentally friendly while practical.

Yet another object of the present invention is to provide a new and improved tank pedestal apparatus, system and method of using the same that may be trailered by trucks into hard to reach areas and deployed without large equipment such as forklifts.

An even further object of the present invention is to provide a new and improved tank pedestal apparatus, system and method of using the same and is transportable along existing highways without special provisions.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices wherein.

DETAILED DESCRIPTION OF THE PREFERRED EMBODIMENTS

Figure 1:
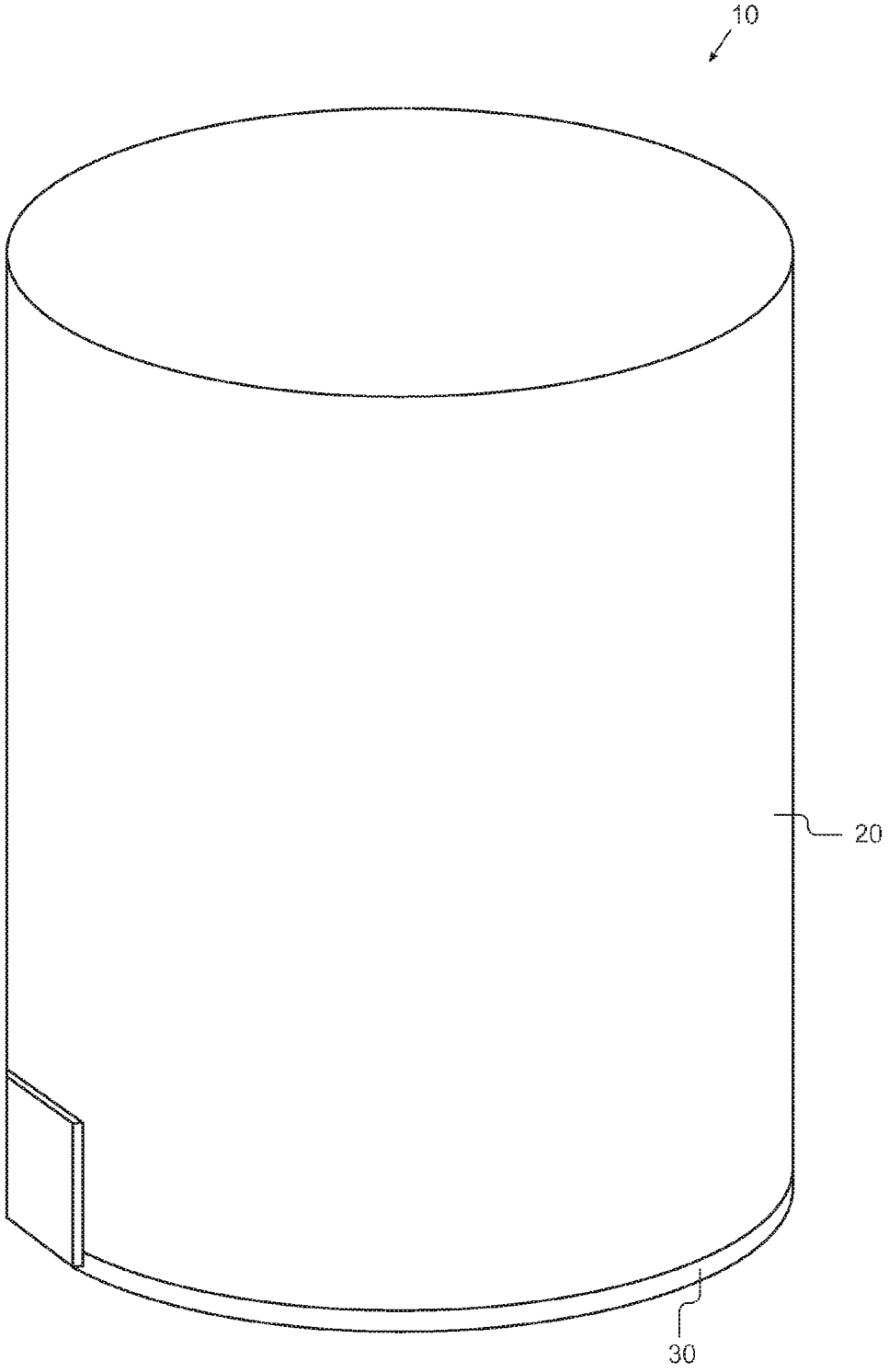
FIG. 1 is a general side perspective illustration of a preferred embodiment of the invention depicting a tank and a base.
Figure 2:
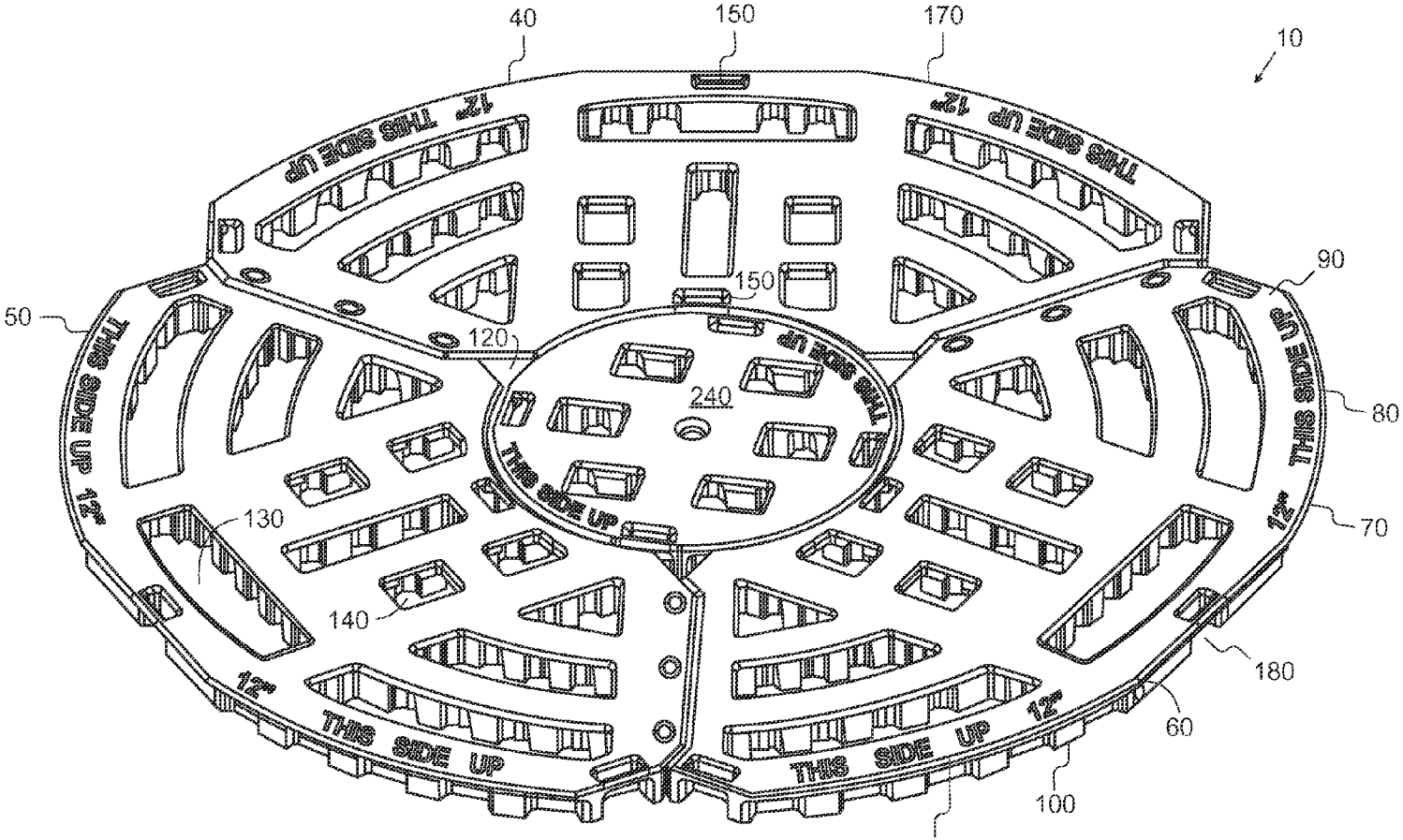
FIG. 2 is a general perspective top illustration of a preferred embodiment of the invention depicting an assembled base.
Figure 3:
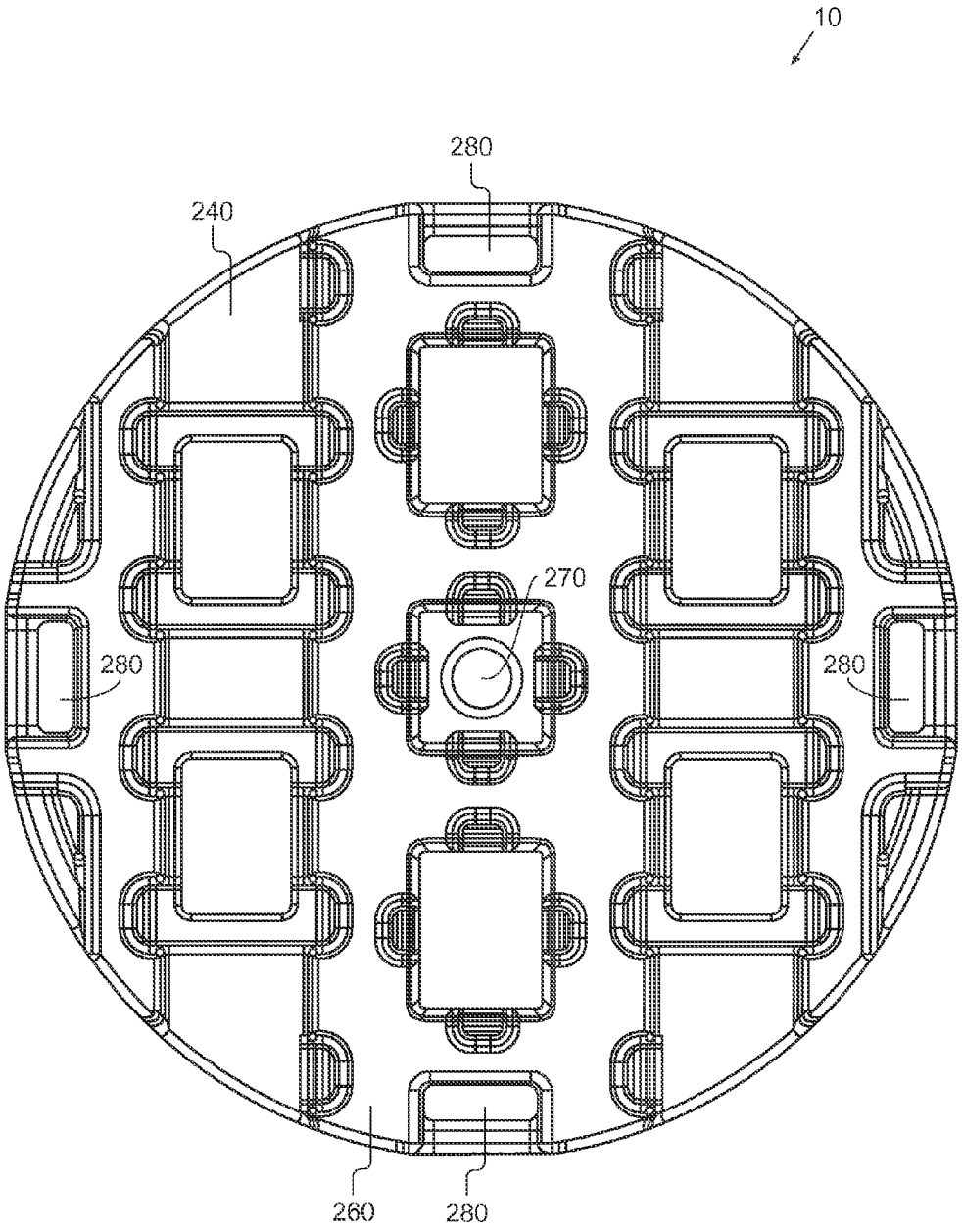
FIG. 3 is a general bottom view illustration of a preferred embodiment of the invention depicting a center piece.
Figure 4:
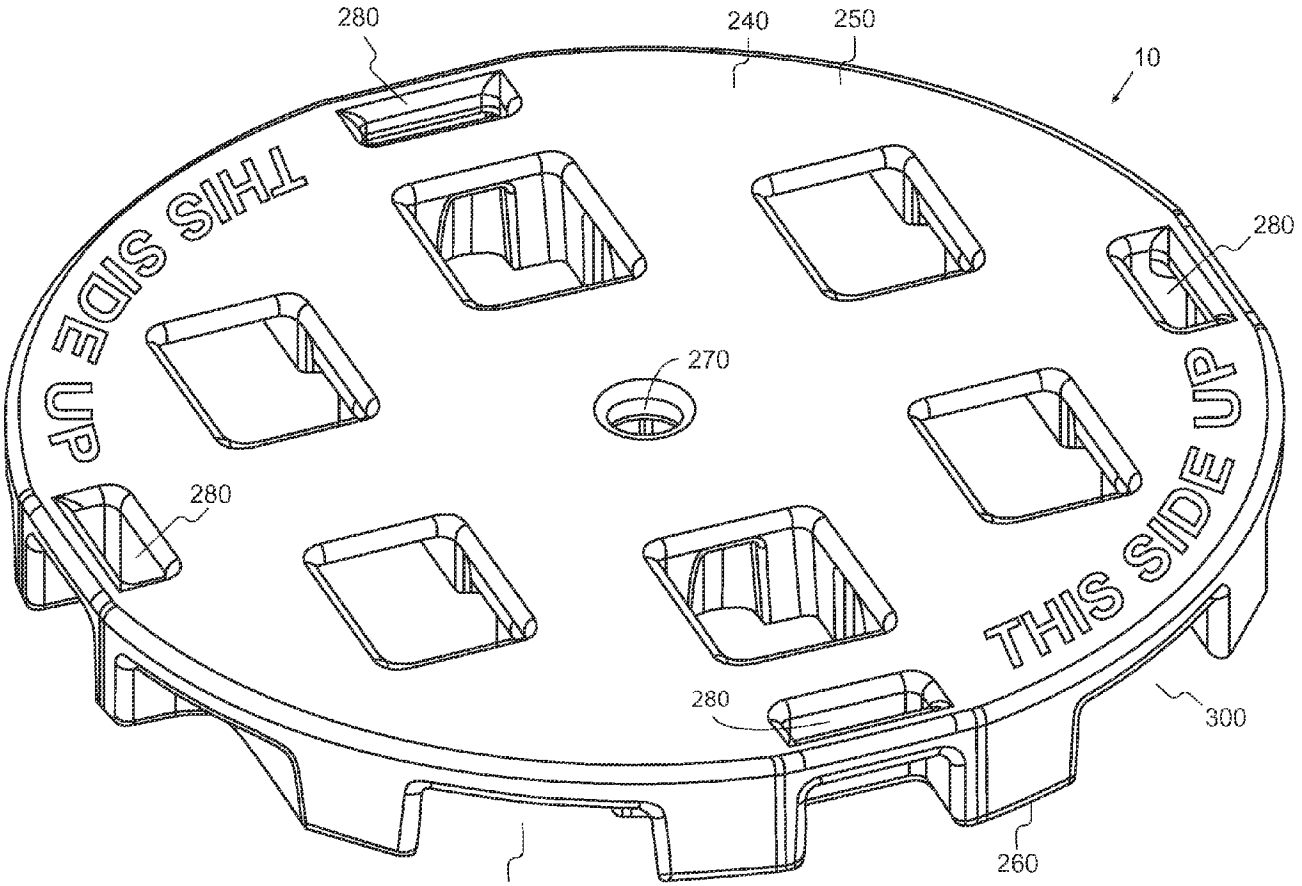
FIG. 4 is a general top perspective illustration of a preferred embodiment of the invention depicting a center piece.
Figure 5:
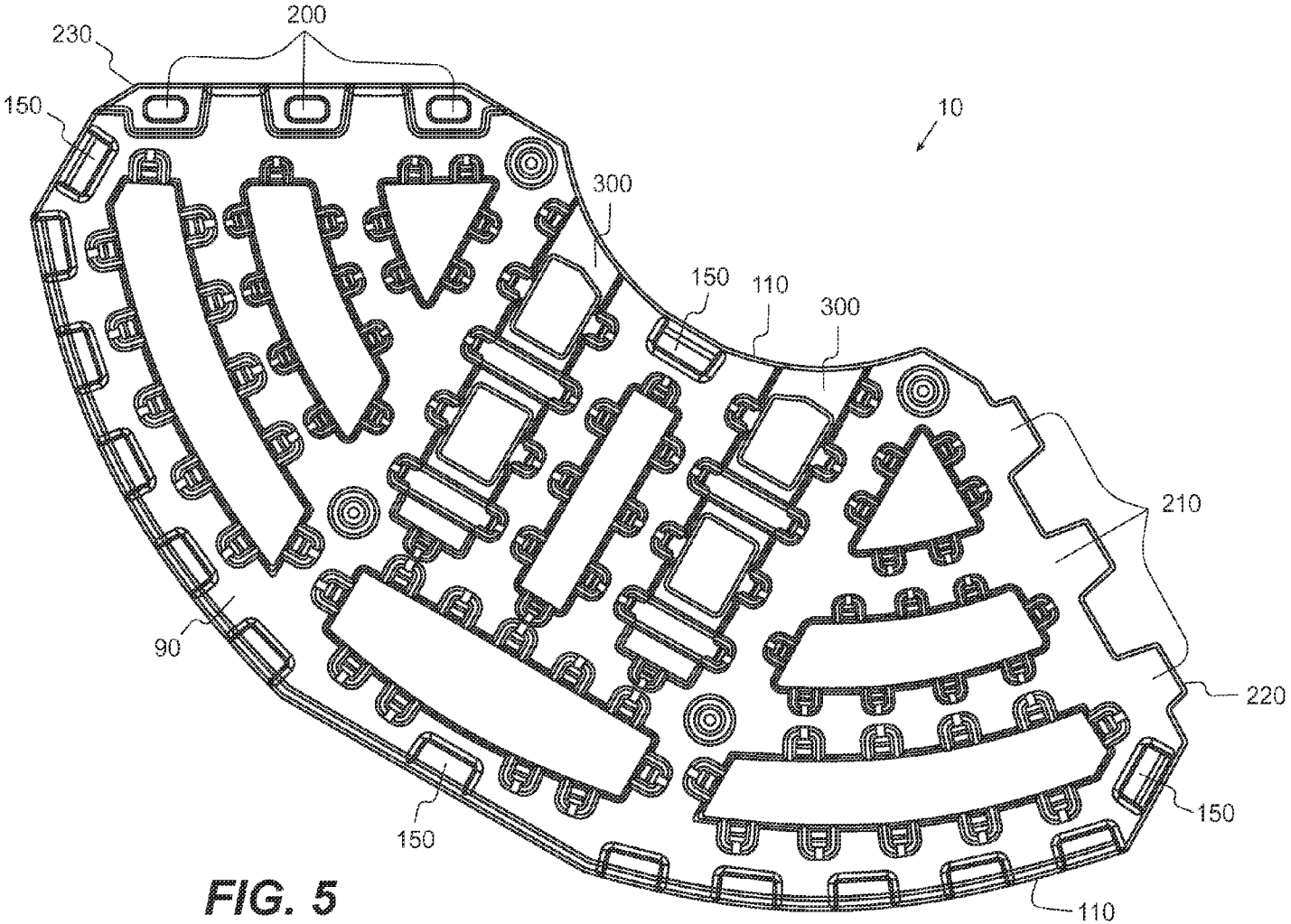
FIG. 5 is a general bottom view illustration of a preferred embodiment of the invention depicting a section piece.
Figure 6:
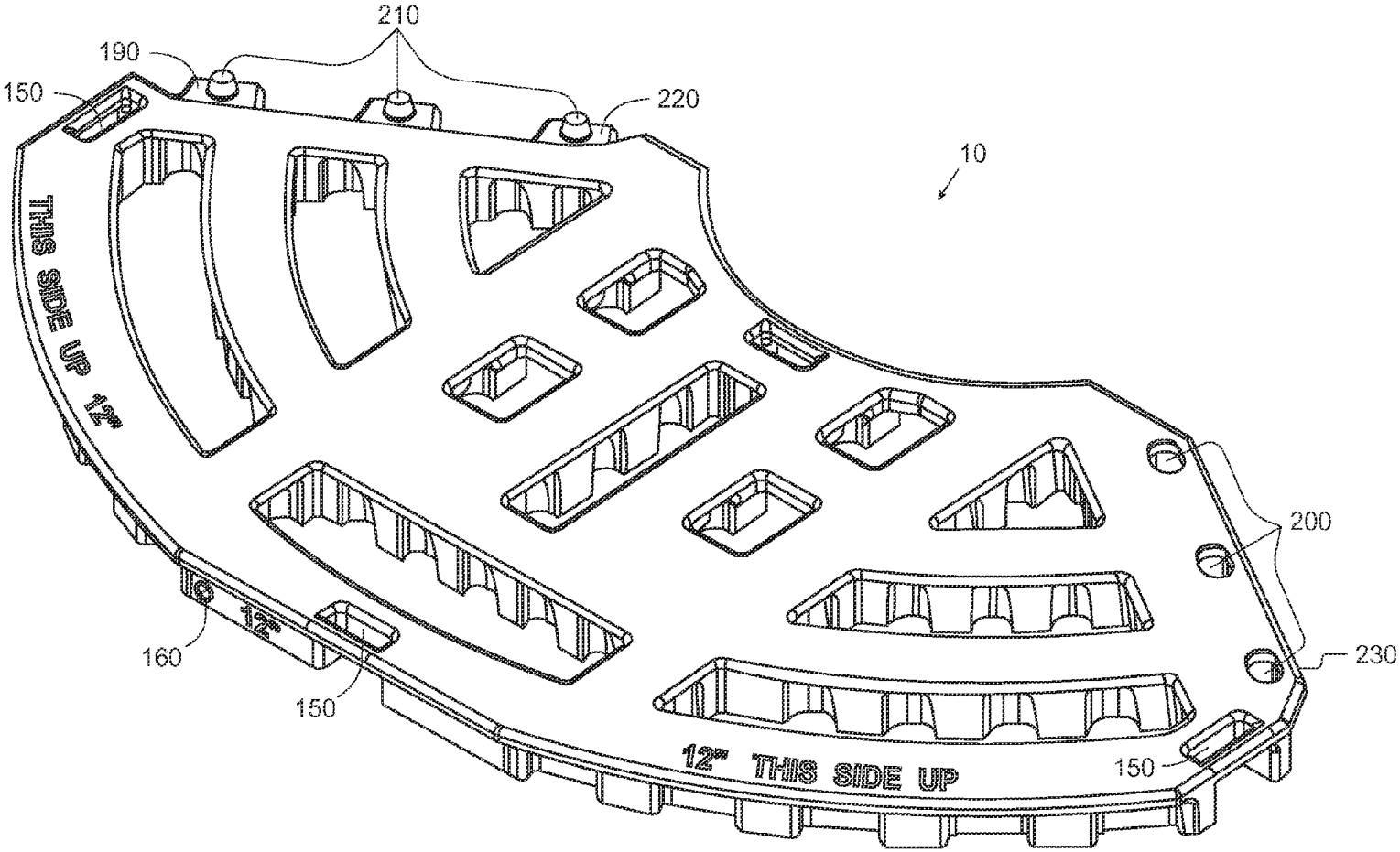
FIG. 6 is a general top perspective illustration of a preferred embodiment of the invention depicting a section piece.
Figure 7:
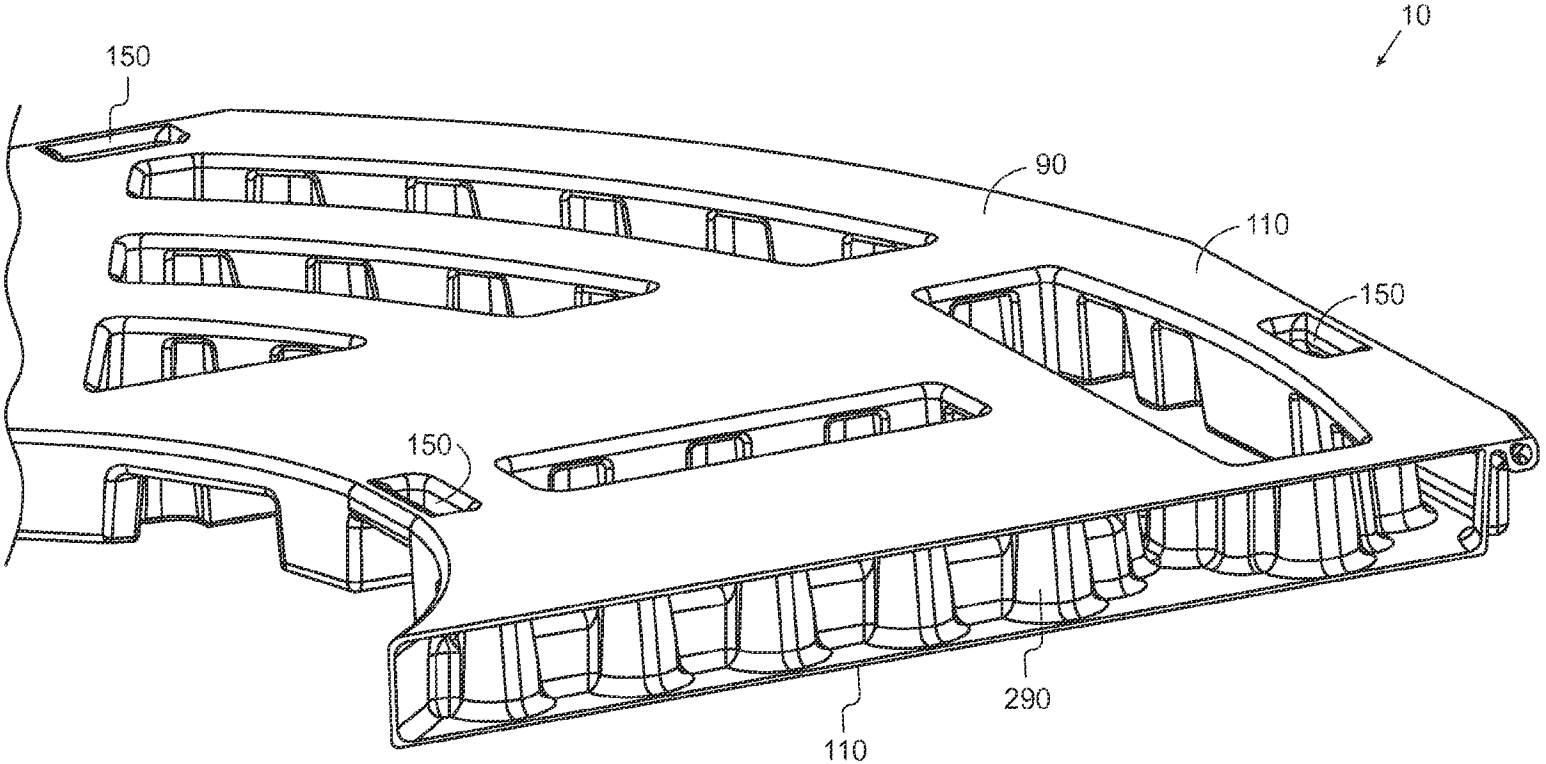
FIG. 7 is a general top perspective partial cut away illustration of a preferred embodiment of the invention depicting a section piece with kiss points.

Referring to the illustrations and to FIG. 1 in particular, reference character 10 generally designates a new and improved tank pedestal apparatus, system and method of using the same constructed in accordance with the present invention. Invention 10 is generally used with a tank 20 and or multiple tanks forming a tank battery where it is desirable to provide a load-bearing support for an aboveground storage tank 20 and configured to reduce rusting and corrosion of the tank from ground moisture, chemicals, and so forth.

It is understood that invention 10 may be utilized in numerous other applications where it is desirable to provide a support platform, base and or pedestal and the current invention should not be considered limited to just oil and gas applications. It is therefore understood that the current invention may be utilized with multiple applications and the current disclosure should not be considered to limit the invention to oil and gas tank 20 and or tank battery. Invention 10 may be used as a base for heaters, separators, used to block up piping inside of the containment system, and so forth.

Again referring to the illustrations, FIG. 1 generally shows rudimentary tank 20 for accommodating an environmentally sensitive and potentially hazardous liquid such as petroleum or various other types of chemicals. Most commonly, such tanks are utilized to hold petroleum and assorted types of hydrocarbon fuels. Potentially hazardous chemicals are also stored in aboveground tanks of this type. Although the typical tank has a generally cylindrical configuration, the particular size, shape, construction and type of tank are not limitations of this invention. The version depicted is for illustrative purposes only and is not intended to accurately depict all the elements associated with tank 20. It should be understood that various alternative tank constructions may be utilized within the scope of this invention. It should also be understood that various types of liquids may be accommodated within and or associated with tank 20.

Invention 10 may generally include a pedestal, platform, and or base 30 that may be a series of interconnectable pie shaped sections such as but not limited to first section 40, second section 50, and third section 60, which can be interlocked together to form a circle 70 with a perimeter 80. Base 30 may have a top 90 for generally locating tank 20 and bottom 100 to be placed on the ground or other surface that tank 20 may be placed such as but not limited to a secondary containment liner known in the art.

It is understood that base 30 may be of a one-piece construction, a two-piece construction, a three-piece construction, a four-piece construction and so forth. Although base 30 is depicted in the illustrations with three sections, invention 10 contemplates numerous variations as well as shapes. By example, base 30 may include a three piece construction for a 12 foot platform whereas a 15 foot 6 inch platform may be made of 4 matching pieces that form a circular pattern. Further, base 30 may be of a non-circular shape such as an ellipse, square, rectangle and so forth. It is understood that other shapes may be utilized such as square with rounded corners and sections for more oval and or circular base 30. It is also understood that numerous diameters are contemplated.

In a preferred construction, first section 40, second section 50, and third section 60 also hereinafter referred to as sections 110 cooperatively form circle 70 with an opening and or aperture 120 that may be utilized to line up base 30 in the correct and or desired spot by marking the subfloor. Sections 110 may further include holes 130 and 140, which may be of numerous configurations, shapes, and numbers other than generally depicted. It is generally contemplated that holes 130 and 140 may allow aid in breathability between tank 20 and a liner or other surface, which may reduce corrosion in general as well as allow any produced fluids to escape contact from the bottom of tank 20 also thereby reducing corrosion.

Invention 10 base 30 sections 110 may include handles 150, which may be molded onto individual sections 110 for easy handling. Handles 150 may be of numerous configurations and may further be detachable. Furthermore, top edge 170 and bottom edge 180 of base 30 may be generally rounded and or curved to generally be gentler on liners.

Still further base 30 may have a designated strong point that may be used to clamp base 30 to the bottom of tank 20. This may allow for placing base 30 on bottom of tank 20 before lowering tank 20 into position. Prior art devices require placing the foam and or gravel in place then lowering a tank, which may lead to errors and essentially requiring a do over. Invention 10 provides for more accurate and easier installation by insuring the placement of base 30 directly under tank 20 as desired during the tank installation process.

Base 30 and or sections 110 may be made from numerous materials with a preferred embodiment being a rigid polyethylene plastic that is non-absorbing, a static electricity reducer and or generally non-conductive, has a long life expectancy, easily stacked, easily shipped, easily stored and generally require minimal labor to set up due to its relatively light weight. It is understood that invention 10 further contemplates other materials such as but are not limited to aluminum, plastic, composite materials, combinations thereof, and so forth.

Invention 10 contemplates forming and or making base 30 from rotational molding that generally involves a heated hollow mold which is filled with a charge or shot weight of material. It is then slowly rotated, usually around two perpendicular axes, causing the softened material to disperse and stick to the walls of the mold. In order to maintain even thickness throughout the part, the mold continues to rotate at all times during the heating phase and to avoid sagging or deformation also during the cooling phase. The process was applied to plastics in the 1940s but in the early years was little used because it was a slow process restricted to a small number of plastics. Over the past two decades, improvements in process control and developments with plastic powders have resulted in a significant increase in usage. An advantage of this type of construction makes base 30 robust in nature. Base 30 may be dragged upon the ground and generally handled roughly with no appreciable damage compared to the prior art foam devices.

It is contemplated that base 30 sections 110 may be a rigid polyethylene plastic platform that fits generally flush under tank 20 and is non-corrosive, chemical resistant, tolerant to temperature variations, and non-absorbing as well as structurally sound to hold a full tank 20. Base 30 sections 110 may be a hollow design that may be made from a process called rotational molding as known in the art. Rotational molding, also called rotomolding or rotocast, is a thermoplastic process for producing hollow parts by placing powder or liquid resin into a hollow mold and then rotating that tool bi-axially in an oven until the resin melts and coats the inside of the mold cavity. It is also contemplated that base 30 could also be filled with dense expanding foam and or other material.

Base 30 sections 110 and or center piece 240 may be molded with braces also known as kiss-offs and or kiss points 290 that build strength through the center core of base 30 and or sections 110. It is understood that kiss-offs increase part stiffness; may be used individually, in a series, pattern and combinations thereof; and may outperform ribs in many cases. It is also known that an almost kiss-off gives nearly the same structural strength without adding a blemish on the outside wall.

Drain holes 160 may be provided in the molding process and or made after the molding process in case liquid fills up the containment. Sections 110 may include fork lift channels 300 for easy stacking and lifting in bundles during transportation and storage.

Furthermore, it is understood that sections 110 may be removably attached together and or non-removably attached together. It is understood that each piece may interlock with the others to keep them from moving. It is also understood that sections 110 may be utilized without being interconnected and generally laid together in a touch fashion and or a non-touching configuration. Attachment assembly 190 may include a female hole 200 to generally align with male pin 210. In a preferred embodiment section 110 has a first side 220 with three male pins 210 and a second side 230 with three female holes 200 wherein sections 110 may overlap to each other for connecting. It is understood that numerous types of attachment assembly 190 are contemplated as well as configuration and number of male and female connectors.

Invention 10 also contemplates a center piece or center 240, which may be utilized and may or may not be secured to sections 110. In a preferred construction center 240 may press fit into the assembled sections 110. Center 240 may have a top 250, a bottom 260, a centering aperture 270, hand holds 280 and so forth. Centering aperture 270 may generally be utilized to center base 30, which may allow for accurate positioning of base 30. Center 240 may also include fork lift channels 300 for easy stacking and lifting in bundles during transportation and storage.

In Operation

Invention 10 contemplates that the modular nature of sections 110 lend to an easy to install and variable size as desired. The assembly is not pre-assembled, but is instead assembled and installed on site. To assemble and create base 30 on site, sections 110 are generally located as desired and interlocked.

Center piece 240 may be utilized to form sections 110 around after centering aperture 270 is aligned where desired. Sections 110 may be placed in an overlapping configuration, fastened together, and or spaced and not attached as desired. It is contemplated that tank 20 may be generally positioned on top 90 of base 30.

It is therefore contemplated invention 10 may be a tank battery pedestal assembly comprising: a first section having a first side with connectors for mating, a second side with connectors for mating, a top side, and a bottom side; a second section having a first side with connectors for mating, a second side with connectors for mating, a top side, and a bottom side; a third section having a first side with connectors for mating, a second side with connectors for mating, a top side, and a bottom side; wherein said first section first side mates with said second section second side, said second section first side mates with said third section second side, said third section first side mates with said first section second side when mated; wherein said first section top side, said second section top side, and said third section top side form a center aperture when mated; and wherein said first section bottom side, said second section bottom side, and said third section bottom side form an outer perimeter when mated.

It is also contemplated that invention 10 may include a center piece adapted to fit inside said center aperture wherein said center piece further includes an alignment hole in the center of said center piece; wherein said center piece further includes venting apertures; and the tank battery pedestal wherein said first section, said second section, said third section, and said center piece are made by rotational molding.

Still further, it is contemplated that invention 10 said first section, said second section, and said third section, and said center piece each include kiss points; wherein said first section, said second section, and said third section each include at least one handle; wherein said center section includes at least one handle; wherein said first section, said second section, and said third section, and said center piece each include venting apertures; wherein said first section, said second section, and said third section each include fork lift channels; wherein said first section first side connectors are male, said first section second side connectors are female; said second section first side connectors are male, said second section second side connectors are female; and said third section first side connectors are male and said third section second side connectors are female.

Changes may be made in the combinations, operations, and arrangements of the various parts and elements described herein without departing from the spirit and scope of the invention.

What is claimed is:

1. A tank battery pedestal assembly comprising:

a first section having a first side with connectors for mating, a second side with connectors for mating, a top side, and a bottom side;

a second section having a first side with connectors for mating, a second side with connectors for mating, a top side, and a bottom side;

a third section having a first side with connectors for mating, a second side with connectors for mating, a top side, and a bottom side;

wherein said first section first side mates with said second section second side, said second section first side mates with said third section second side, said third section first side mates with said first section second side when mated;

wherein said first section top side, said second section top side, and said third section top side form a center aperture when mated;

wherein said first section bottom side, said second section bottom side, and said third section bottom side form an outer perimeter when mated; and a center piece adapted to fit inside said center aperture and wherein said center piece further includes an alignment hole in the center of said center piece.

2. The tank battery pedestal of claim 1 wherein said center piece further includes venting apertures.

3. The tank battery pedestal of claim 2 wherein said first section, said second section, said third section, and said center piece are made by rotational molding.

4. The tank battery pedestal of claim 3 wherein said first section, said second section, and said third section, and said center piece each include kiss points.

5. The tank battery pedestal of claim 4 wherein said first section, said second section, and said third section each include at least one handle.

6. The tank battery pedestal of claim 5 wherein said center section includes at least one handle.

7. The tank battery pedestal of claim 6 wherein said first section, said second section, and said third section each include venting apertures.

8. The tank battery pedestal of claim 7 wherein said first section, said second section, and said third section each include fork lift channels.

9. The tank battery pedestal of claim 8 wherein said first section first side connectors are male, said first section second side connectors are female; said second section first side connectors are male, said second section second side connectors are female; and said third section first side connectors are male and said third section second side connectors are female.

* * * * *